US005722216A

United States Patent [19]

Meier

[11] Patent Number: 5,722,216

[45] Date of Patent: Mar. 3, 1998

[54] PROCESS FOR STORING SHEET-LIKE PRODUCTS

[75] Inventor: Jacques Meier, Bäretswil, Switzerland

[73] Assignee: Ferag AG, Hinwil, Switzerland

[21] Appl. No.: 422,715

[22] Filed: Apr. 13, 1995

[30] Foreign Application Priority Data

Apr. 15, 1994 [CH] Switzerland ..... 01 148/94

[51] Int. Cl.[6] ..... B65B 63/04

[52] U.S. Cl. ..... 53/430; 53/118; 53/168; 242/528

[58] Field of Search ..... 53/118, 168, 430; 242/528, 530, 530.1, 530.2, 530.3, 530.4

[56] References Cited

U.S. PATENT DOCUMENTS

| | | | |
|---|---|---|---|
| 4,494,359 | 1/1985 | Honegger . | |
| 4,525,982 | 7/1985 | Meier . | |
| 4,528,798 | 7/1985 | Meier . | |
| 4,550,883 | 11/1985 | Boss | 242/528 |
| 4,575,988 | 3/1986 | Meier . | |
| 4,580,739 | 4/1986 | Linder | 53/430 X |
| 4,597,243 | 7/1986 | Honegger | 53/430 |
| 4,697,400 | 10/1987 | Gerber . | |
| 4,832,273 | 5/1989 | Honegger | 53/118 X |
| 4,866,910 | 9/1989 | Reist . | |
| 4,898,336 | 2/1990 | Reist . | |
| 4,903,908 | 2/1990 | Hansch | 53/430 X |
| 4,903,909 | 2/1990 | Suzuki . | |
| 4,953,843 | 9/1990 | Reist | 242/528 X |
| 4,993,653 | 2/1991 | Frei . | |
| 5,176,333 | 1/1993 | Stauber . | |

FOREIGN PATENT DOCUMENTS

| | | | |
|---|---|---|---|
| 0229888 | 7/1987 | European Pat. Off. . | |
| 0272398 | 7/1988 | European Pat. Off. . | |
| 2216108 | 10/1989 | United Kingdom | 242/528 |

*Primary Examiner*—Daniel Moon
*Attorney, Agent, or Firm*—Brinks Hofer Gilson & Lione

[57] ABSTRACT

A process for storing sheet-like products occurring continuously, in particular in an imbricated formation, in particular printed products such as newspapers, periodicals and the like, in the case of which process the sheet-like products are wound up on, and/or unwound from, a main roll, a first number of the products being wound up on, and/or unwound from, a first main roll (4) and a second number of the products being wound up on, and/or unwound from, a second main roll which is assigned to the first main roll.

51 Claims, 11 Drawing Sheets

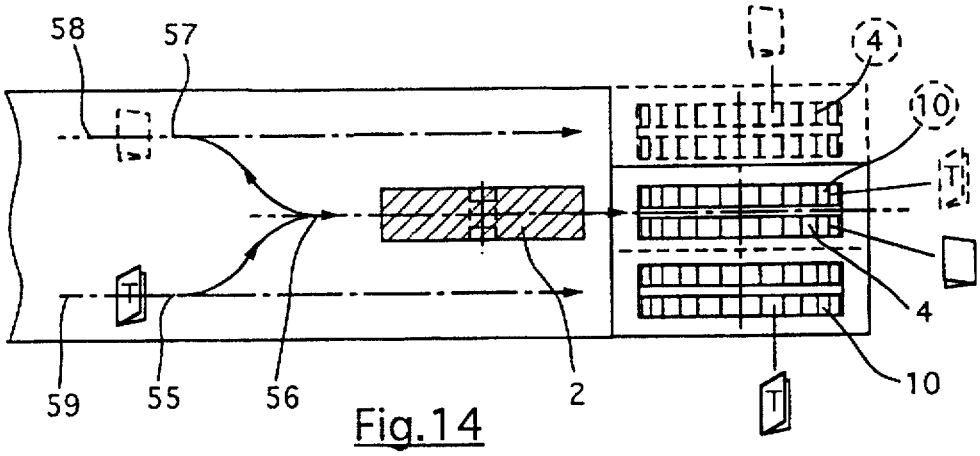
Fig.14
Fig.15
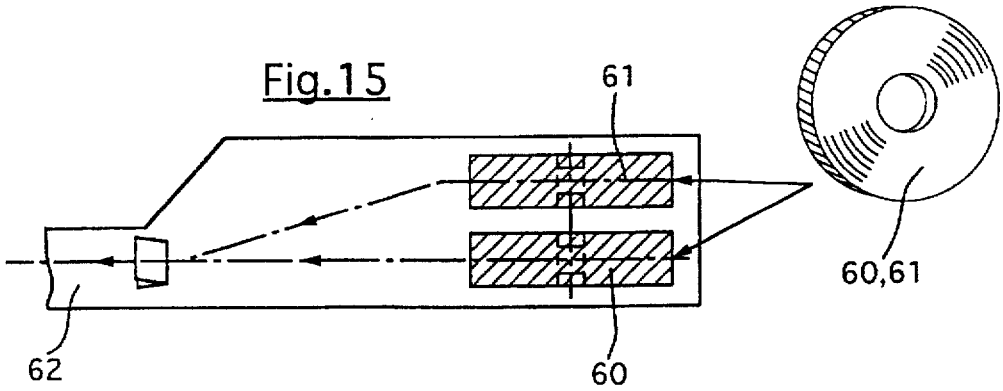
Fig.16
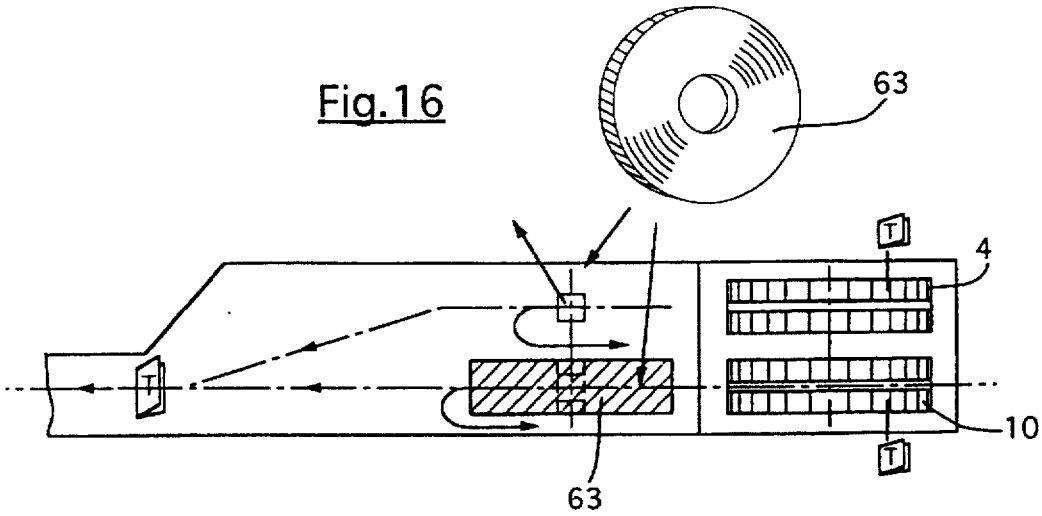

PROCESS FOR STORING SHEET-LIKE PRODUCTS

BACKGROUND OF THE INVENTION

The invention relates to a process and apparatus for carrying out a process for storing sheet-like products occurring continuously, in particular in an imbricated formation, in particular printed products such as newspapers, periodicals and the like. When this process is performed the sheet-like products are wound up on, and/or unwound from, a main roll.

A process of this type is shown in U.S. Pat. No. 4,575,988 and its corresponding German Offen Legungsschrift DE 32-44-664. In the process disclosed in this patent a first, preceding number of the products are wound up on a main roll in a delayed manner and simultaneously with a second, following number of the products. The delay is achieved in that the first preceding number of the products is first wound up on an intermediate roll, whereupon it is then unwound from the intermediate roll again during the feeding of the second, following number of the products. This results in simultaneous winding-up of the first number and of the second number of the products on the main roll is achieved.

In this prior an process, it is essential that the first and the second number of the products are fed to the main roll such that they are located one on top of the other. This results in a two-layered wound arrangement is obtained on the main roll.

While the continuously occurring product stream is wound up on the intermediate roll, the main roll has no function to fulfil, and during the corresponding period of time, a main roll which has previously been fully wound can be transported away and exchanged for an empty main roll. By virtue of the provision of the intermediate roll and the described interaction of the intermediate roll with the main roll, it is, accordingly, possible to wind a plurality of main rolls one after the other without it being necessary to interrupt the continuous product stream when a full main roll is being exchanged for an empty main roll.

U.S. Pat. No. 4,525,982 and its corresponding German Offen Legungsschrift DE 32-44-664 describe an arrangement wherein the unwinding of products located in two layers one upon the other on a main roll to produce a continuous product stream can take place in an analogous manner. In this arrangement one layer of the products is guided away from the main roll directly and the other layer is fed to the intermediate roll, whereupon, when the main roll is empty, the layer which, in the meantime, is located on the intermediate roll is unwound. While this layer is being unwound from the intermediate roll, the empty main roll can be exchanged for a full main roll.

Therefore it is an object of the invention to provide an improved process for storing continuously occurring sheet-like products, which process can be used in numerous ways and can be adapted to different case applications.

SUMMARY OF THE INVENTION

This object is achieved according to the invention in an arrangement wherein a first number of the products is wound up on, and/or unwound from, a first main roll and a second number of the products is wound up on, and/or unwound from, a second main roll which is assigned to the first main roll.

By virtue of the use, according to the invention, of two separate, but, in particular, mechanically interconnected, main rolls, it is no longer necessary to wind up the products on the main roll, such that they are located one on top of the other, as a two-layered wound arrangement. This is possible since a product stream passing directly to the winding arrangement can be wound, for example, on the first main roll and a second product stream, for example originating from an intermediate roll, can be wound on the second main roll. By virtue of this measure according to the invention, considerably more flexible operation is made possible, this being explained in detail hereinbelow with reference to a number of examples.

If the first and the second main rolls are coupled to one another mechanically, this results in particularly simple and practical handleability of the double rolls formed in this manner.

BRIEF DESCRIPTION OF THE DRAWINGS

Exemplary embodiments of the subject matter of the invention are explained in more detail below with reference to the drawings, in which:

FIG. 14 shows a schematic representation of the possible product stream in the event of products being wound up according to the invention by further preferred apparatus.

FIG. 15 shows the product stream in the case of an alternative mode of operation of an apparatus according to FIGS. 11 to 14.

FIG. 16 shows the product stream in the case of a further alternative mode of operation of an apparatus according to FIGS. 11 to 14.

DETAILED DESCRIPTION OF THE PREFERRED EMBODIMENTS

Figure 1:
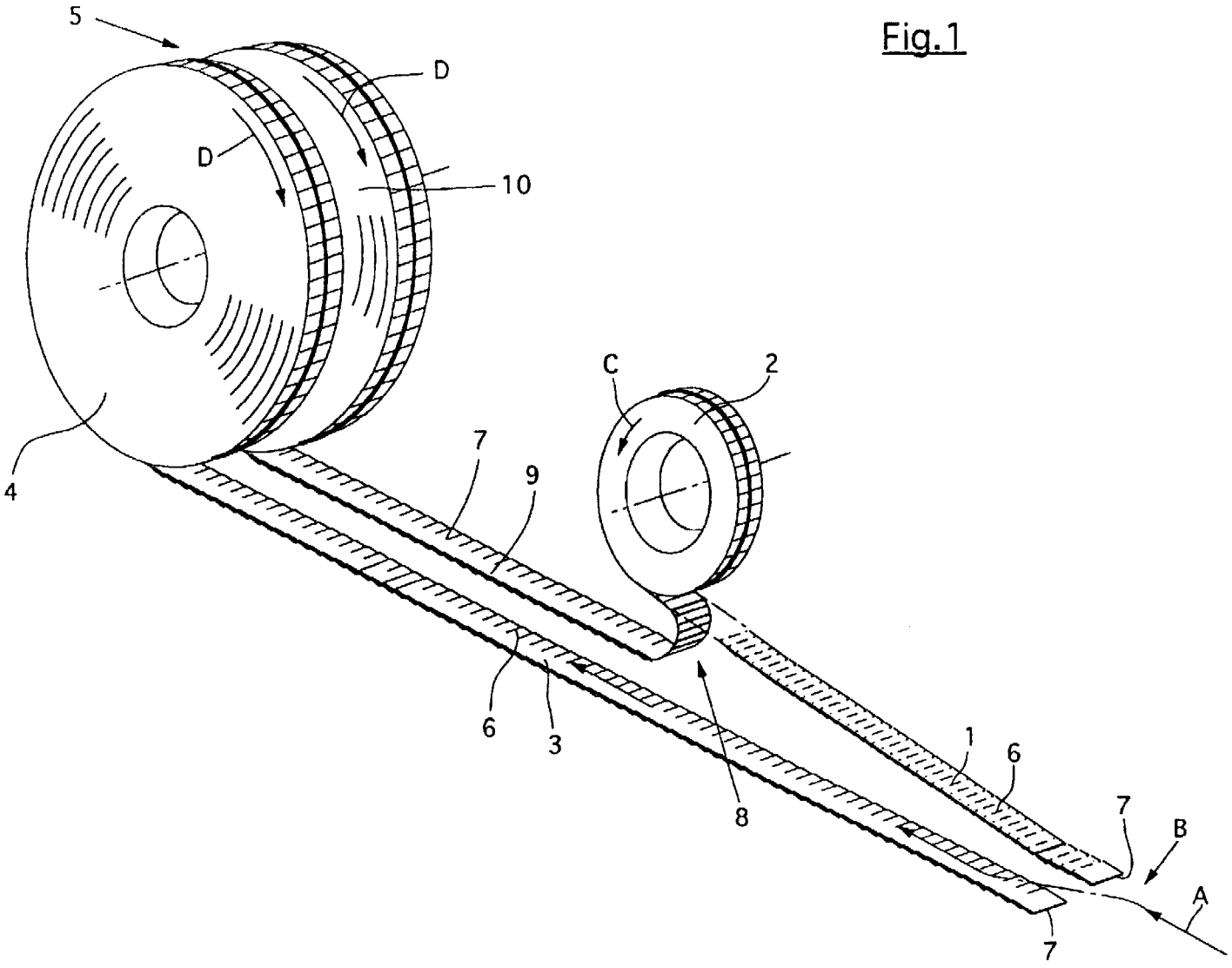
FIG. 1 shows the operation of winding up a product stream on a winding arrangement, designed in two parts according to a preferred embodiment of the invention.

Referring now to the drawings, FIG. 1 shows the winding-up operation or winding arrangement 5 according to an embodiment of the process of the invention. An imbricated stream flowing continuously in the direction of arrow A changes direction, through a switch (not shown) situated in region B, to a conveying device that conveys the imbricated stream 1 to an intermediate roll 2. Intermediate roll 2 is rotated counter to the direction of arrow C seen in FIG. 1, in order to wind up the imbricated stream 1 on the intermediate roll 2.

As soon as the intermediate roll 2 is fully wound, the switch at B is activated, resulting in the imbricated stream following in accordance with arrow A to the first main roll 4 as imbricated stream 3.

After the imbricated stream 1, which is interrupted by the changeover of the switch at B, is fully wound up on the intermediate roll 2, the direction of rotation of said intermediate roll 2 is reversed, with the result that the direction of rotation of the intermediate roll 2 is now as indicated in FIG. 1 by the arrow C.

Both the imbricated stream 1 leading to the intermediate roll 2 and the imbricated stream 3 leading to the first main roll 4 originate from the imbricated stream which is continuously fed to the overall apparatus in the direction of arrow A. The folded printed products forming the imbricated stream are always oriented such that the folded edge 6 forms the leading edge of the printed product and the open edge 7 forms the trailing edge of the printed product, and the folded edges 6 are always resting on top of the preceding product. Accordingly, the products are wound up with the leading folded edges 6 facing the winding cores of both the intermediate roll 2 and the first main roll 4.

The imbricated stream is fed to the main rolls 4, 10 and/or to the intermediate roll 2 essentially in a horizontal plane from that side of the intermediate roll 2 that is remote from the main rolls 4, 10.

By virtue of the changeover of the direction of rotation of the intermediate roll 2, the products stored on the intermediate roll 2 are unwound therefrom, the direction of flow of the products being reversed. In this manner the imbricated stream 9 that has been established, has its leading edge formed by the open edges 7 of the respective printed product, said open edges 7 coming to rest on top of the preceding printed product. This imbricated stream 9 is fed to the second main roll 10.

Simultaneously, therefore, the imbricated stream 3 is fed directly to the first main roll 4 and the imbricated stream 9 is fed to the second main roll 10 from the intermediate roll 2. During this winding-up operation, both the first and the second main rolls 4, 10 rotate in the direction indicated by the arrows D.

In this arrangement, the axes of rotation of the two main rolls 4, 10 of the winding arrangement 5 are coaxially aligned preferably mechanically coupled.

In the winding-up process represented in FIG. 1, there is obtained, on the first main roll 4, a product formation in which the leading folded edge 6 of the products is facing the winding core. On the second main roll 10 is the leading open edge 7 is facing the winding core.

If the intermediate roll 2 were not, as represented in FIG. 1, assigned to the second main roll 10, but to the first main roll 4, a correspondingly reversed product formation could be achieved on the main roll. In this formation, on the first main roll 4, the leading open edge 7 would be facing the respective winding core and, on the second main roll 10, the leading folded edge 6 would be facing the respective winding core.

By means of a process according to FIG. 1, a continuously inflowing product stream can be stored on a plurality of winding arrangements since a wound winding arrangement can be exchanged for an empty winding arrangement while the intermediate roll is being wound.

Figure 2:
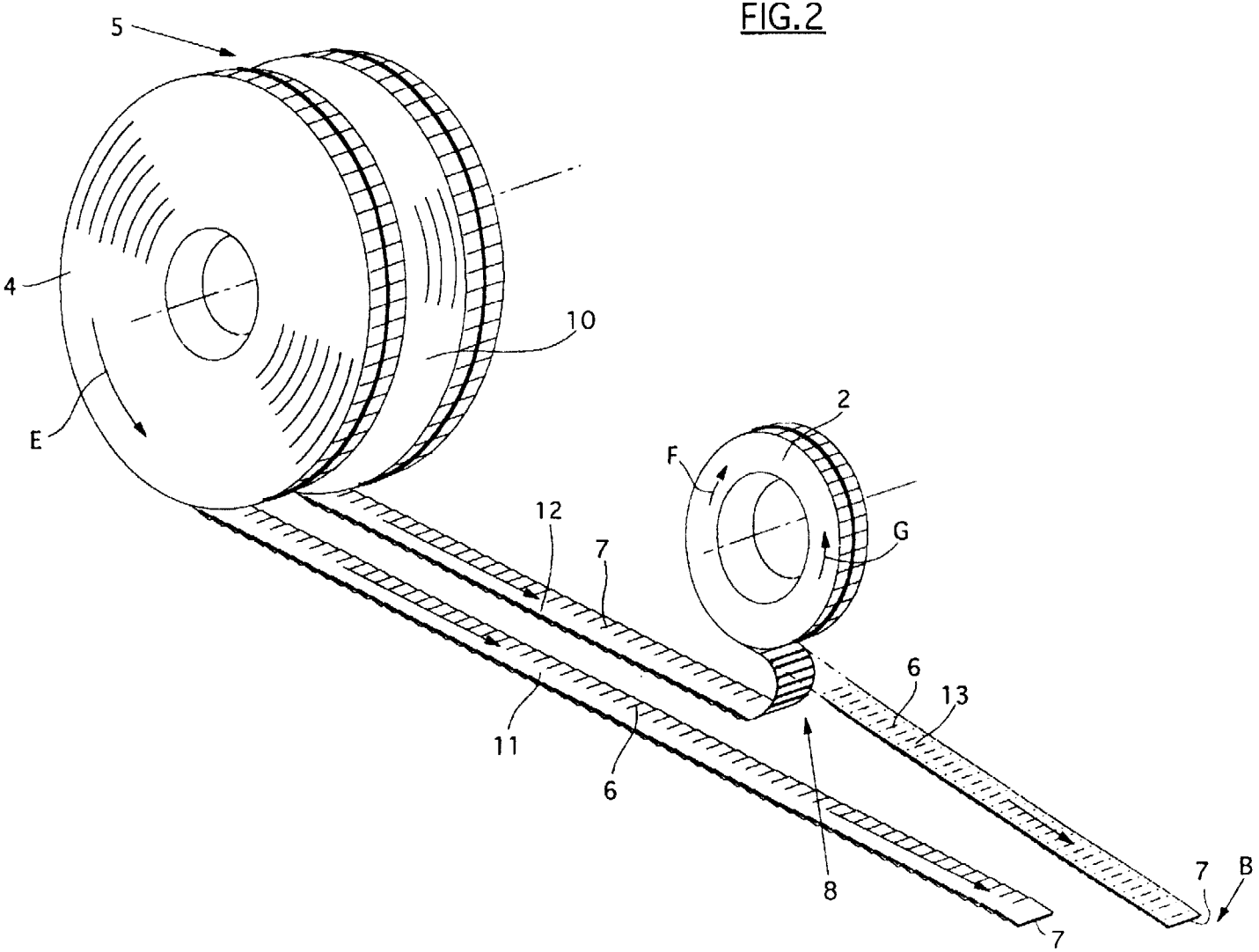
FIG. 2 shows a first possible way of unwinding a product stream from a winding arrangement according to FIG. 1.

The unwinding of a product stream from a winding arrangement 5 wound according to FIG. 1 is illustrated in FIG. 2. The winding arrangement 5, on first and second main rolls 4, 10, seen in FIG. 2 were wound by the process described with reference to FIG. 1.

During unwinding, the two main rolls 4, 10 are driven in the direction of the arrow E, this resulting in a first product stream 11 that is guided away from the first main roll 4 and a second product stream 12 that is simultaneously guided away from the second main roll 10.

In this arrangement, the product stream 11 is oriented such that its leading edge is formed by the open edges 7 of the product, said open edges 7 coming to rest beneath the preceding product in each case. The second product stream 12 originating from the second main roll 10 is oriented such that the leading edge of the products is formed by the folded edges 6 thereof, said folded edges 6 coming to rest beneath the preceding product in each case.

The product stream 11 is, with its indicated orientation, guided away from the first main roll 4 directly for the purpose of further processing.

The second product stream 12 originating from the second main roll 10 is, while the first product stream 11 is being guided away for the purpose of its further processing, wound up on the intermediate roll 2 which rotates in the direction of the arrow F. The second product stream 12 has, before being wound up on the intermediate roll 2, the leading edge of the product stream formed by the folded edge 6 of the product. The feed direction of the strand 12 is reversed at 8, and the leading edge of the product stream 12 is formed by the folded edge 6 of the products. The folded edges 6 thus face the winding core of the intermediate roll 2.

When the end of the first product stream 11 passes the switch (not shown) located at B, the winding arrangement 5 is completely empty and all the products which were stored on the second main roll 10 are non-wound on the intermediate roll 2. At this point in time, a changeover of the direction of rotation of the intermediate roll 2 takes place, with the result that intermediate roll 2 now rotates in the direction of the arrow G.

As a result of this rotation of the intermediate roll 2, the products stored thereon, without further reversing, are guided away from the intermediate roll 2 as a third product stream 13. The changeover of the direction of rotation of the intermediate roll 2 and the actuation of the switch arranged at B are respectively timed such that the third product stream 13 joins, without any interruption, the product stream 11 originating from the first main roll 4. As a result a continuous product stream is guided away from the apparatus illustrated in FIG. 2.

Since the third product stream 13 flowing from the intermediate roll 2 has not been reversed, the products are oriented such that the open edge 7 is the leading edge. The open edge 7 is located beneath the respectively preceding product. The orientation of the third product stream 13 is thus identical to the orientation of the first product stream 11.

While the third product stream 13 is being unwound from the intermediate roll 2, the empty winding arrangement 5 can be exchanged for a new and fully wound winding arrangement. As soon as the intermediate roll 2 is fully unwound, the new winding arrangement is then made to rotate again in such a manner that the product stream unwound from the first main roll of the new winding arrangement joins the third product stream 13 of the intermediate roll 2 without interruption. In this manner, a continuous product stream can be produced, which is not interrupted during the exchange of the winding arrangement.

The imbricated stream of products flowing away from the apparatus represented schematically in FIG. 2 is guided in an essentially horizontal stream from the side of the intermediate roll 2 that is remote from the main rolls 4 and 10.

Figure 3:
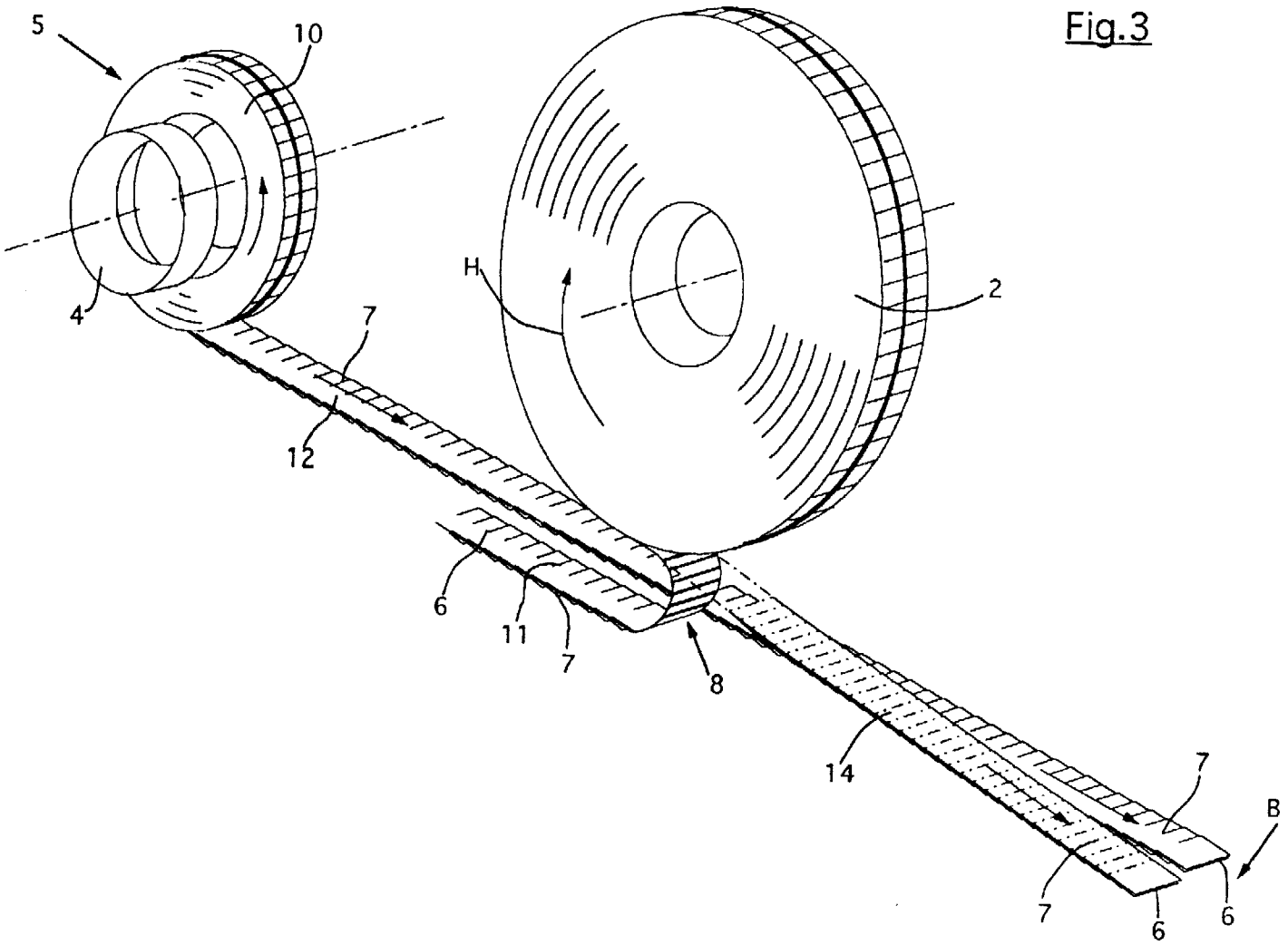
FIG. 3 shows a second possible way of unwinding a product stream from a winding arrangement according to FIG. 1.

The process represented in FIG. 3 is similar to the process represented in FIG. 2, but, here, the intermediate roll 2 is associated with the first main roll 4. The first and second main rolls 4, 10, of FIG. 3 were previously wound by the process described with reference to FIG. 1.

The winding process according to FIG. 3 functions analogously to the process according to FIG. 2, except, by virtue of the intermediate roll 2 being associated with the first main roll 4, there is the following difference:

According to the unwinding process of FIG. 3, the products unwound from the second main roll 10 are directly guided away from the apparatus for the purpose of further processing. In this arrangement, the product stream 12 originating from the second main roll 10 is oriented analogously to FIG. 2, such that the leading edge of the products is formed by the folded edge 6 of the products. The folded edges 6 come to rest beneath the preceding product. In this respect, the product stream, as seen in FIG. 3, that is flowing away from the overall apparatus has a different orientation of FIG. 2 since, in FIG. 2, the leading edge of the product stream is formed by the open edge 7 of the products.

When the product is wound up by the process illustrated in FIG. 1, the product stream 11 unwinding from the first main roll 4 is oriented such that the leading edge is formed by an open edge 7. The open edge 7 of each product rest beneath the preceding product. The product stream 11 is, according to FIG. 3, wound up on the intermediate roll 2 after its direction of flow has been reversed at 8.

During winding up on the intermediate roll 2 in the direction of the arrow H, the products are thus oriented such that the leading edge is formed by the open edge 7 of the products, the open edge 7 facing the winding core of the intermediate roll 2.

At the point in time at which the product stream 12 originating from the second main roll 10 passes the switch positioned at B, all the products previously located on the first main roll 4 have been wound on the intermediate roll 2. The intermediate roll 2 is then driven counter to the direction of the arrow H, whereupon the products stored on the intermediate roll 2 are unwound and guided away as product stream 14 through the correspondingly changed-over switch.

In this arrangement, the timing of the switch and the changeover of the direction of rotation of the intermediate roll 2 is controlled analogously to FIG. 2 such that the product stream 14 joins, without interruption, the end of the product stream 12 originating from the second main roll 10, in order to thus ensure continuity of the product stream that is being guided away.

Since the product stream unwound from the intermediate roll 2 is not turned, this product stream 14 originating from the intermediate roll 2 is oriented such that the leading edge is formed by the folded edge 6, the folded edge coming to rest beneath the preceding product in each case. The product stream 14 is thus oriented in precisely the same way as the product stream 12 originating from the second main roll 10.

As illustrated in FIG. 3 the first main roll 4, which is assigned to the intermediate roll 2, is fully unwound before the second main roll 10 is fully unwound. This can be achieved, for example, by providing drives for the main rolls 4, 10 such that they can be driven at different speeds.

Since the first main roll 4 is, according to FIG. 3, is unwound quicker than the second main roll 10, during unwinding of the remaining products from the second main roll 10, there is sufficient time to reverse the direction of rotation of the intermediate roll 2. In this manner, it is ensured that there is no interruption between the end of the product stream originating from the second main roll 10 and the beginning of the product stream originating from the intermediate roll 2.

In order to accomplish this same result when unwinding according to FIG. 2, the second main roll 10 can, be driven faster than the first main roll 4.

Corresponding continuity can also be achieved by, during the wind up procedure, winding fewer products on the main roll that will be assigned to the intermediate roll during unwinding than are wound up on the main roll from which the products are directly guided away. In this case, the two main rolls can be driven at the same speed.

Another way of achieving continuous unwinding is to, during winding up, delaying the start of the products that are fed to the main roll assigned to the intermediate roll during unwinding. In this case, it is also possible for the two main rolls to be driven at the same speed of rotation.

By optionally assigning the intermediate roll 2 to either of the main rolls 4 or 10, the winding arrangements 5 illustrated in FIG. 1 can optionally be unwound in an identical manner such that the leading product edge rest beneath the preceding product can be formed either by the folded edge or by the open edge of the products. This, as a feature of the subject invention provides great flexibility during further processing of the products.

Figure 4:
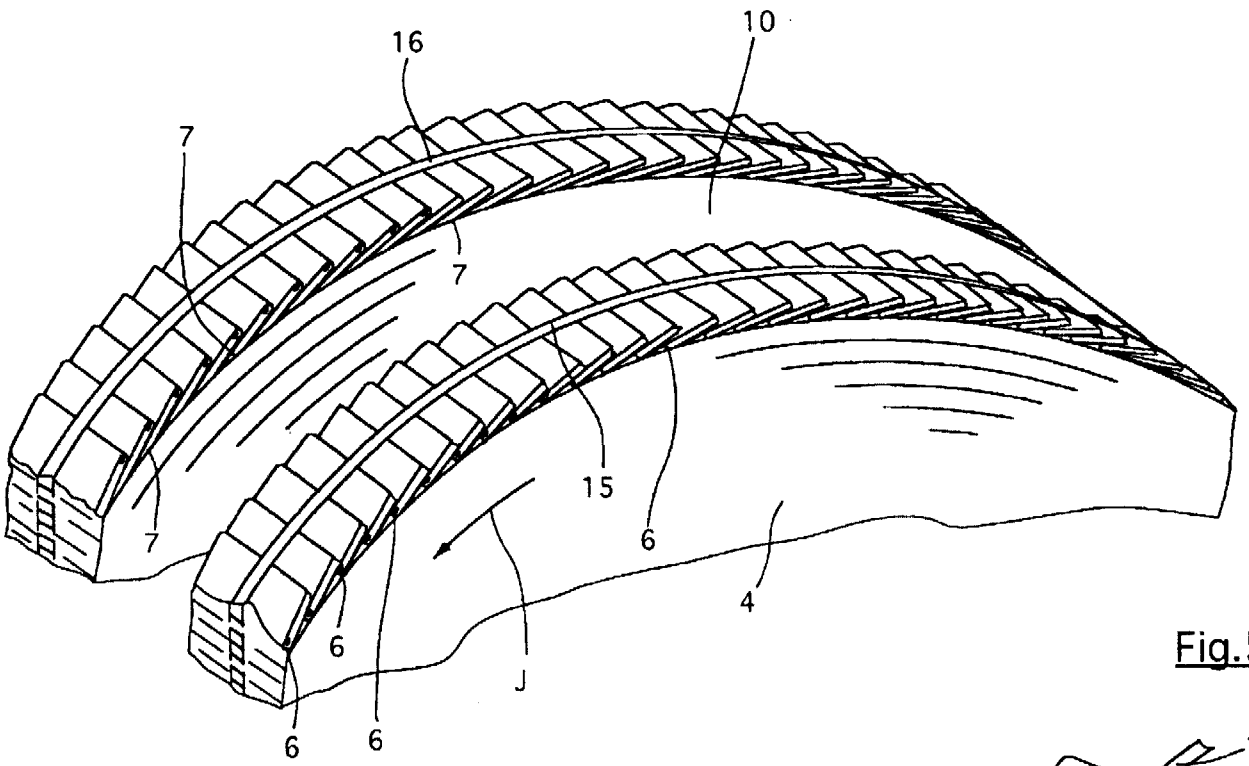
FIG. 4 shows products wound up on a winding arrangement, designed in two parts according to a preferred embodiment of the invention.

FIG. 4 shows a first main roll 4 and a second main roll 10 each with printed products wound up thereon. In this arrangement, the printed products located on the first main roll 4 are oriented such that the folded edge 6 thereof forms the leading edge, in relation to the direction of rotation J, said leading edge facing the winding core of the first main roll 4.

In contrast, the printed products on the second main roll 10 are oriented such that the leading edge, in relation to the direction of rotation J, is formed by the open edge 7 of the printed products, the open edge 7 facing the winding core of the second main roll 10 in each case.

The printed products are retained on the two main rolls 4, 10 in each case by separating bands 15, 16 which are wound in between the individual wound layers.

The direction of rotation J according to FIG. 4 can, depending on the application, represent both the winding-up direction and the unwinding direction.

Figure 5:
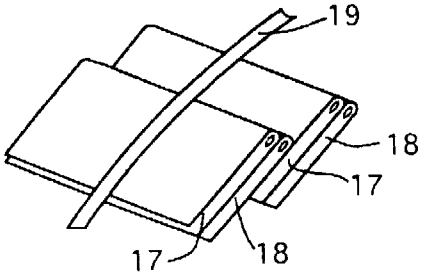
FIG. 5 shows a product formation wound up in two layers.

FIG. 5 shows an imbricated arrangement of printed products that is modified with respect to FIG. 4. In the modification illustrated in FIG. 4 two products 17, 18 rest essentially flush one above the other and the printed products 17, 18 are retained by a separating band 19.

Such a double imbricated arrangement can be processed, by a process according to the invention, in the same way as a single imbricated arrangement of the type described with reference to FIGS. 1 to 4.

Figure 6:
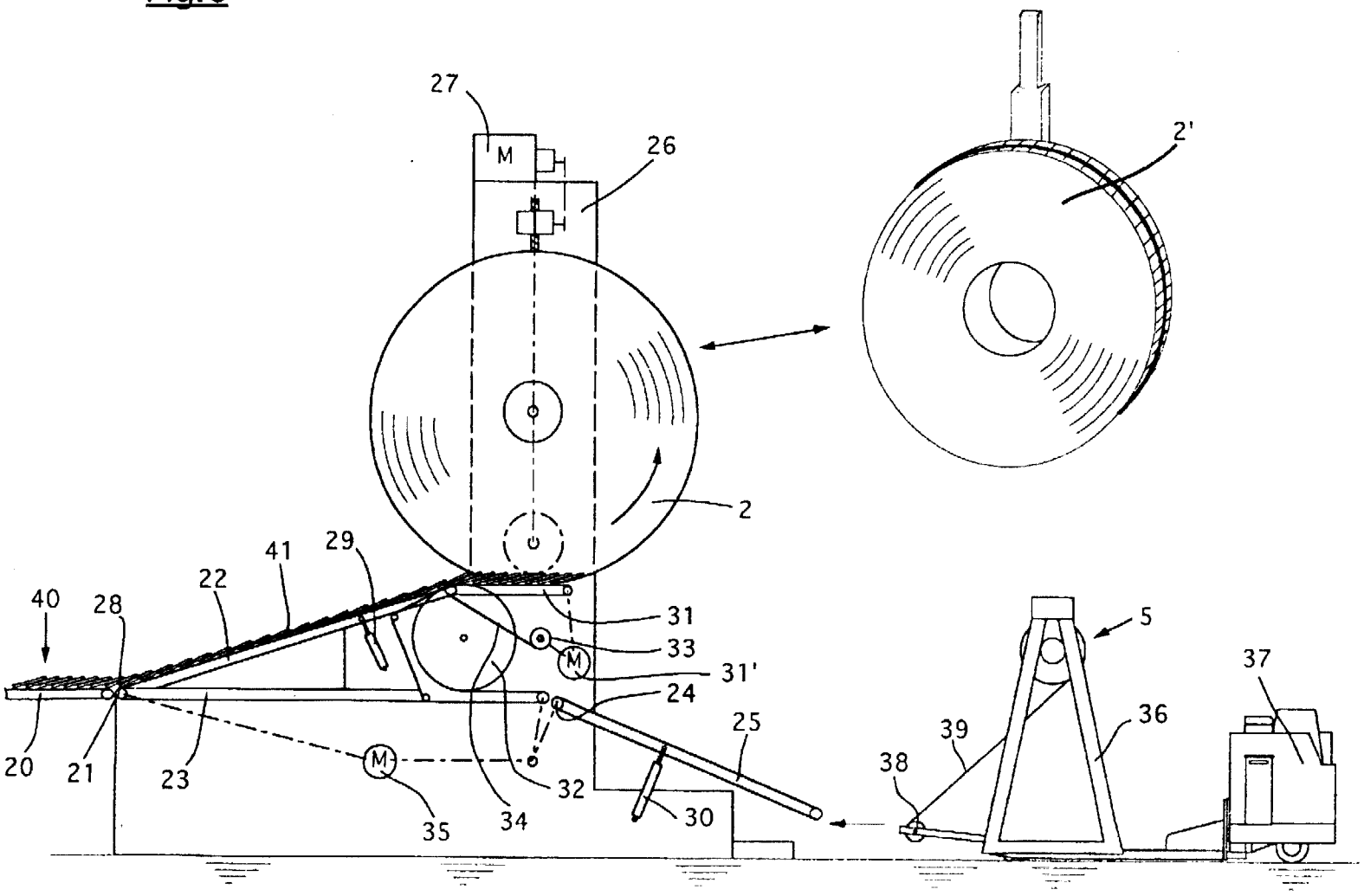
FIG. 6 shows an apparatus for carrying out the winding-up process according to a preferred embodiment of the invention, in a first process stage.
Figure 7:
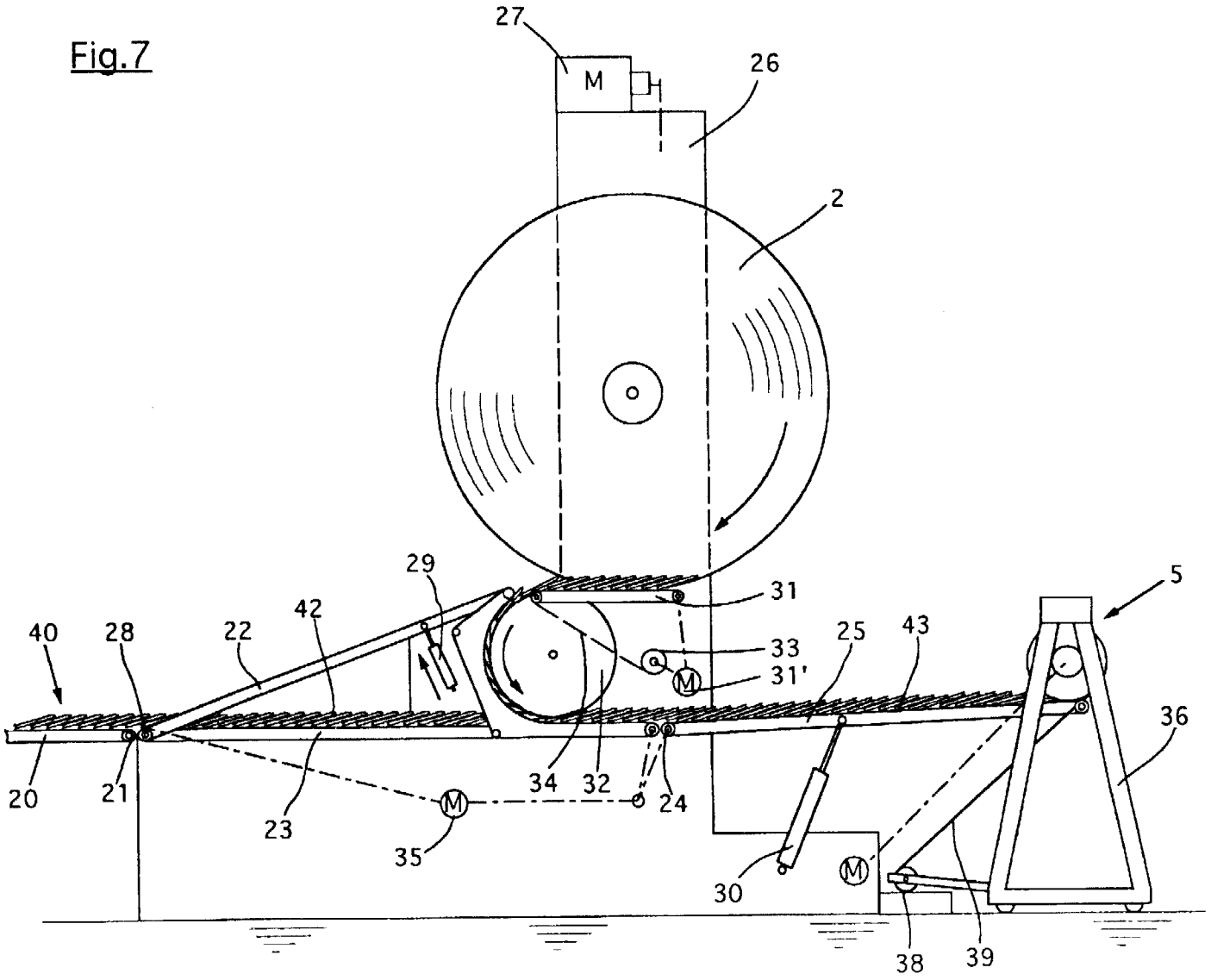
FIG. 7 shows an apparatus for carrying out the winding-up process according to a preferred embodiment of the invention, in a second process stage.
Figure 8:
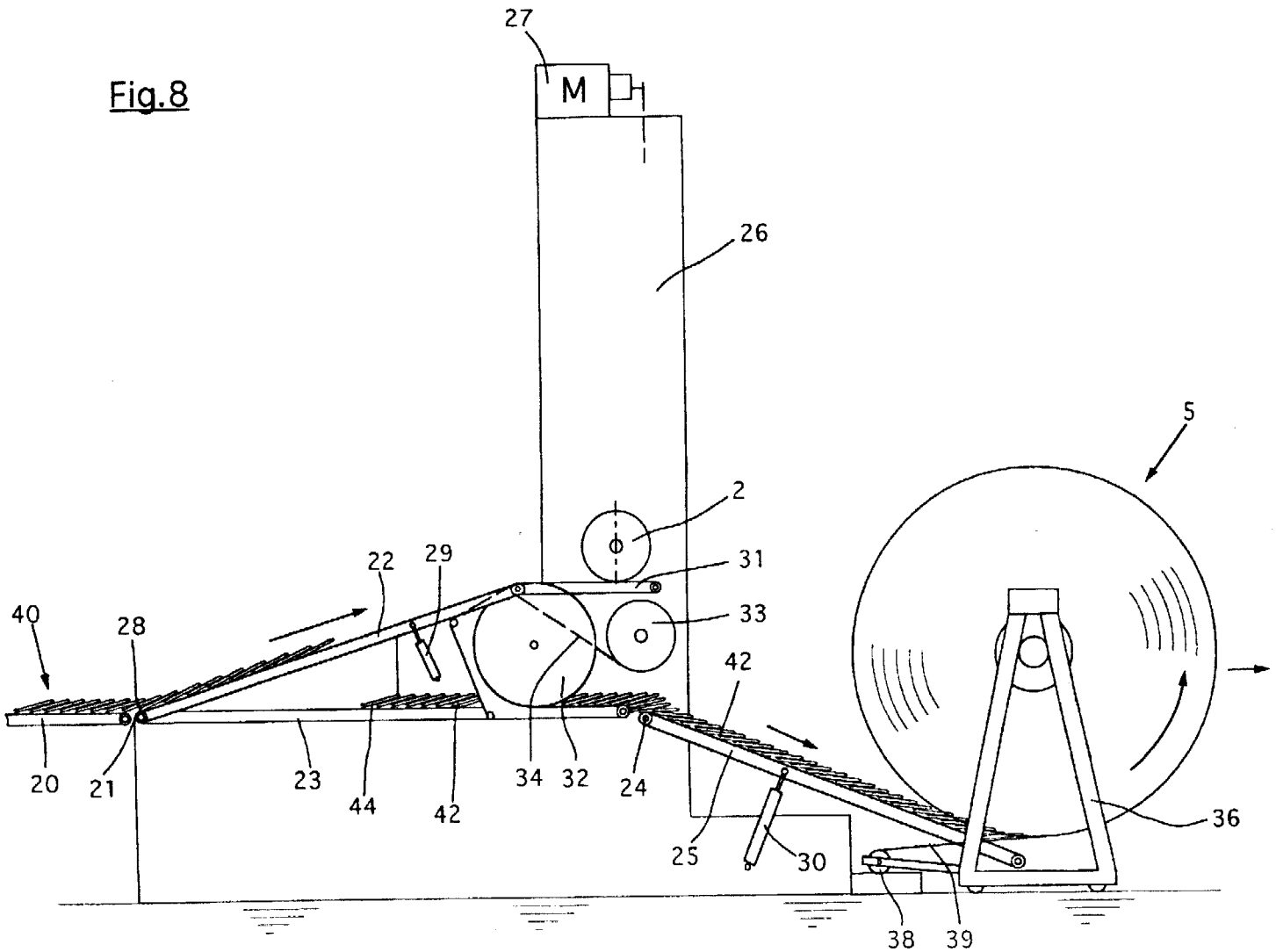
FIG. 8 shows an apparatus for carrying out the winding-up process according to a preferred embodiment of the invention, in a third process stage.

FIGS. 6 to 8 show three different stages of an apparatus in the process for carrying out a winding-up operation according to the invention.

The winding-up station represented in these figures includes a feeding device designated 20 that feeds to a switch 21 through which printed products can optionally be fed, through a first branch 22, to an intermediate roll 2 or, through a second branch 23, to a conveying device 25 that can be pivoted about an axis 24. The conveying device 25 feeds the product to a winding arrangement 5 comprising a first main roll and a second main roll.

The intermediate roll 2 is mounted vertically displaceably in a framework 26 and is coupled to a rotary drive device 27. The intermediate roll 2 mounted in the framework 26 and activated by the rotary drive device 27 may be a winding station of the type described in U.S. Pat. No. 4,898,336

The first branch 22 is mounted such that it can be rotated about an axis 28, and it can be activated by a lifting-piston arrangement 29.

In the same way, the conveying device 25, which can be pivoted about the axis 24, can be activated by a second lifting-piston arrangement 30.

Provided at the bottom region of the intermediate roll 2 is a conveying device 31 which extends essentially horizontal, and is driven by a motor 31'. The conveying device 31 conveys the printed products from the first branch 22 to the intermediate roll 2, from the intermediate roll 2 to the first branch 22, or from the intermediate roll 2 to a reversing device essentially comprising a roller-like reversing element 32. In this arrangement, the roller-like reversing element 32 is aligned with its axis of rotation parallel to the axis of rotation of the intermediate roll 2 and is positioned beneath the conveying device 31, at the end thereof which is remote from the intermediate roll 2.

Furthermore, arranged beneath the intermediate roll 2 is a supply roller 33 for a separating band 34 one end of which is connected to the winding core of the intermediate roll 2 and can be wound in between the wound layers formed by the printed products on the intermediate roll 2.

The conveying mechanism of the first branch 22 and of the second branch 23 as well as the conveying device 25 are driven by a drive 35.

The winding arrangement 5 is housed in a mobile framework 36 which can be moved, for example, by a fork lift truck 37 and can be coupled to the winding-up station.

Connected to the mobile framework 36 are two supply rollers 38 which exhibit a common axis of rotation and are intended for separating bands 39. In this arrangement, one separating band is assigned to the first main roll of the winding arrangement 5 and the second separating band is assigned to the second main roll of the winding arrangement 5. The separating bands 39 function in the same manner as separating band 34 of the intermediate roll 2.

It is indicated in FIG. 6 that the intermediate roll 2 may be designed such that it can be removed from the framework 26, which makes it possible to load into the framework 26, for example, a ready wound intermediate roll 2'.

The winding-up station shown in FIGS. 6 to 8 functions as follows:

As a result of the feeding device 20, a continuous imbricated stream 40 of printed products is fed to the apparatus. In this imbricated stream the leading edge is formed by the folded edge of the printed product, and the folded edge rest on the preceding printed product.

According to FIG. 6, the imbricated stream 40 is first fed, through the switch 21 and the first branch 22, to the intermediate roll 2 as imbricated steam 41, with the interposition of the conveying device 31. In this embodiment, the intermediate roll 2 rotates in the direction indicated by the arrow. As the imbricated stream 41 is being wound up on the intermediate roll 2, the separating band 34 is being unwound from the supply roller 33. As a result, the wound layers on the intermediate roll 2 are separated from one another.

In this arrangement, by virtue of its orientation, the imbricated stream 41 is wound up on the intermediate roll 2 such that the folded edge of the printed products is facing the winding core of the intermediate roll 2.

As soon as the intermediate roll 2 is fully wound, its direction of rotation is reversed, as indicated in FIG. 7, and the lifting-piston arrangement 29 is actuated such that the first branch 22 is raised up slightly from the roller-like reversing element 32.

Furthermore, the switch 21 is simultaneously changed over. The result is that the imbricated stream 40 is transported, through the second branch 23, as imbricated stream 42.

By virtue of the reversal in the direction of rotation of the intermediate roll 2 and the actuation of lifting-piston arrangement 29, the printed products which have been wound up on the intermediate roll 2 are unwound therefrom and fed to the roller-like reversing element 32. This ensures that the imbricated stream 43 running away from the intermediate roll 2 is oriented with the leading edge formed by the open edge of the printed products which open edge comes to rest on the respectively preceding printed product.

After reversing, the imbricated stream 43 is fed, through the conveying device 25, to the second main roller 10 of the winding arrangement 5. At the same time, the imbricated stream 42 also passes, through the second branch 23, to the conveying device 25, from which it is fed to the first main roll 4 of the winding arrangement 5.

With respect to the process step illustrated in FIG. 7, the two imbricated streams 42 and 43 are wound up, simultaneously and in parallel, on the first and second main rolls, respectively, of the winding arrangement 5. In FIG. 7, only the imbricated stream 43 originating from the intermediate roll 2, however, can be seen in the region of the conveying device 25 since the imbricated stream 42 originating from the feeding means 20 is concealed by the imbricated stream 43.

During further winding up of the winding arrangement 5, the lifting-piston arrangement 30 is actuated in such a manner that the angle of inclination of the conveying device 25 becomes greater and greater, thus ensuring tangential feeding of the imbricated streams 42, 43 to the winding arrangement 5, the diameter of which becomes greater as the winding time proceeds.

As the imbricated streams 42, 43 are wound up on the winding arrangement 5, the two separating bands 39 are, at the same time, drawn off the supply rollers 38. As a result the individual wound layers are separated from one another.

FIG. 8 illustrates the step in the process at which the winding arrangement 5 is virtually fully wound. The intermediate roll 2 is fully unwound, it being possible to effect this, for example, in that the second main roll, which is assigned to the intermediate roll 2, of the winding arrangement 5 is rotated at a greater rate than the first main roll of the winding arrangement 5. This ensured that the intermediate roll 2 is emptied early enough and is ready to receive a new imbricated stream.

Shortly before the process step illustrated in FIG. 8, the switch 21 was changed from the position seen in FIG. 7, such that the imbricated stream 40 carried by the feeding means 20 once again passes, through the first branch 22, to the intermediate roll 2.

The end 44 of the imbricated stream 42 conveyed over the second branch 23 ultimately passes, through the conveying device 25, to the first main roll of the winding arrangement 5, whereupon the winding arrangement 5 is fully wound. While the remainder, of the imbricated stream 42 which can be seen in FIG. 8, passes to the winding arrangement 5, the switch 21 and the lifting-piston arrangement 29 are re-set such that the imbricated stream 40 fed by the feeding means 20 passes to the intermediate roll 2 and is wound up thereon.

As the imbricated stream 40 is wound up on the intermediate roll 2, the fully wound winding arrangement 5 can be removed from the apparatus in the arrow direction and exchanged for an empty winding arrangement. Subsequently, the winding-up operation described with reference to FIGS. 6 to 8 is then repeated. A continuously fed winding stream 40 can thus be wound up on winding arrangements 5 without the imbricated stream having to be interrupted or stopped during the exchange of the winding arrangements 5.

The apparatus shown in FIGS. 6 to 8 thus permits a winding up process according to FIG. 1 to be carried out, in which printed products are wound up on a winding arrangement, comprising a first main roll and a second main roll, having the orientation specified in FIG. 1.

Figure 9:
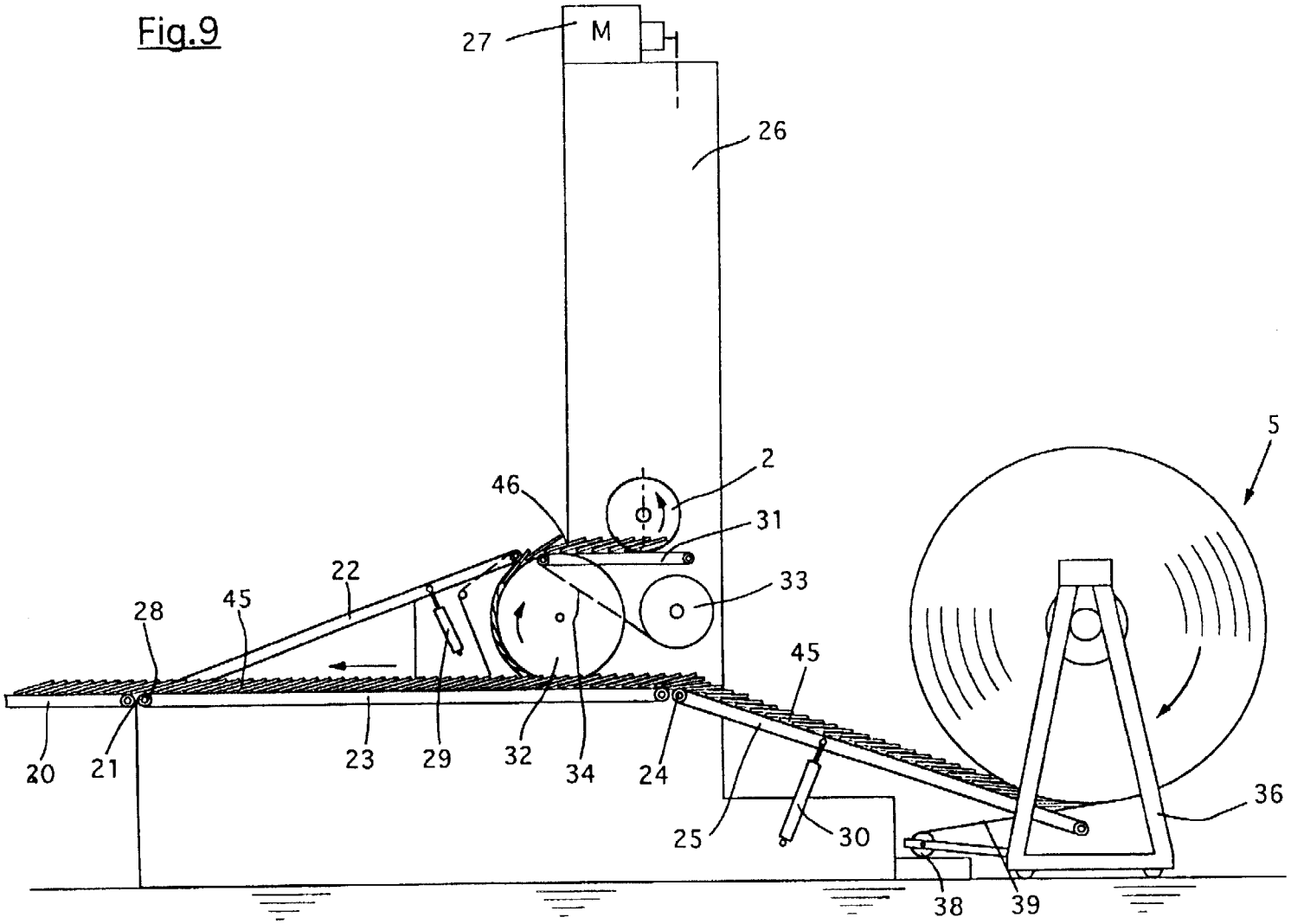
FIG. 9 shows an apparatus for carrying out the unwinding process according to a preferred embodiment of the invention, in a first process stage.

FIG. 9 shows an apparatus which corresponds to FIGS. 6 to 8, and in which the same reference numerals are used. Unlike FIGS. 6 to 8, the apparatus illustrated in FIG. 9 for unwinding printed products from the winding arrangement 5.

In this arrangement, the fully wound winding arrangement is caused to rotate in the direction indicated by the arrow, and the separating bands 39 are simultaneously being wound up on the supply rollers 38. By virtue of this rotation, two imbricated streams located one beside the other, one behind the other in the perspective view of FIG. 9, pass simultaneously on the conveying device 25.

The front imbricated stream 45, which can be seen in FIG. 9, originates from the second main roll 10 and is oriented such that the leading edge of the products is formed by the folded edge thereof, the folded edges resting beneath the preceding product. This imbricated stream 45 passes from the conveying device 25 to the second branch 23 which, just as the conveying device 25, is operated in the opposite direction in comparison with FIGS. 6 to 8.

The imbricated stream 45 passes through the switch 21 to the removal means 20, resulting in a continuous imbricated stream being available for further processing.

The imbricated stream which occurs simultaneously with the imbricated stream 45 and originates from the first main roll 4 passes, through the conveying device 25, to the roller-like reversing element 32, where its orientation is reversed. In front of the roller-like reversing element 32, the leading edge of the imbricated stream is formed by the open edge of the printed products, said open edges resting beneath the preceding printed product. Reversing, caused by the roller-like reversing element 32, of said imbricated stream results in the imbricated stream 46, being fed by the conveying device 31, to the intermediate roll 2. In this arrangement, the imbricated stream 46 is oriented such that the leading edge is formed by the open edges of the printed products, the open edges coming to rest, in this case, above the preceding product. The printed products are thus wound up on the intermediate roll 2 such that the open edges of the printed products is facing the winding core of the intermediate roll 2.

In the step of the process illustrated in FIG. 9, on the one hand an imbricated stream 45, originating from the second main roll 10 and running away from the overall apparatus, is thus produced. On the other hand, an imbricated stream originating from the first main roll 4 is simultaneously wound up on the intermediate roll 2. This unwinding operation corresponds to the principle represented in FIG. 3.

Figure 10:
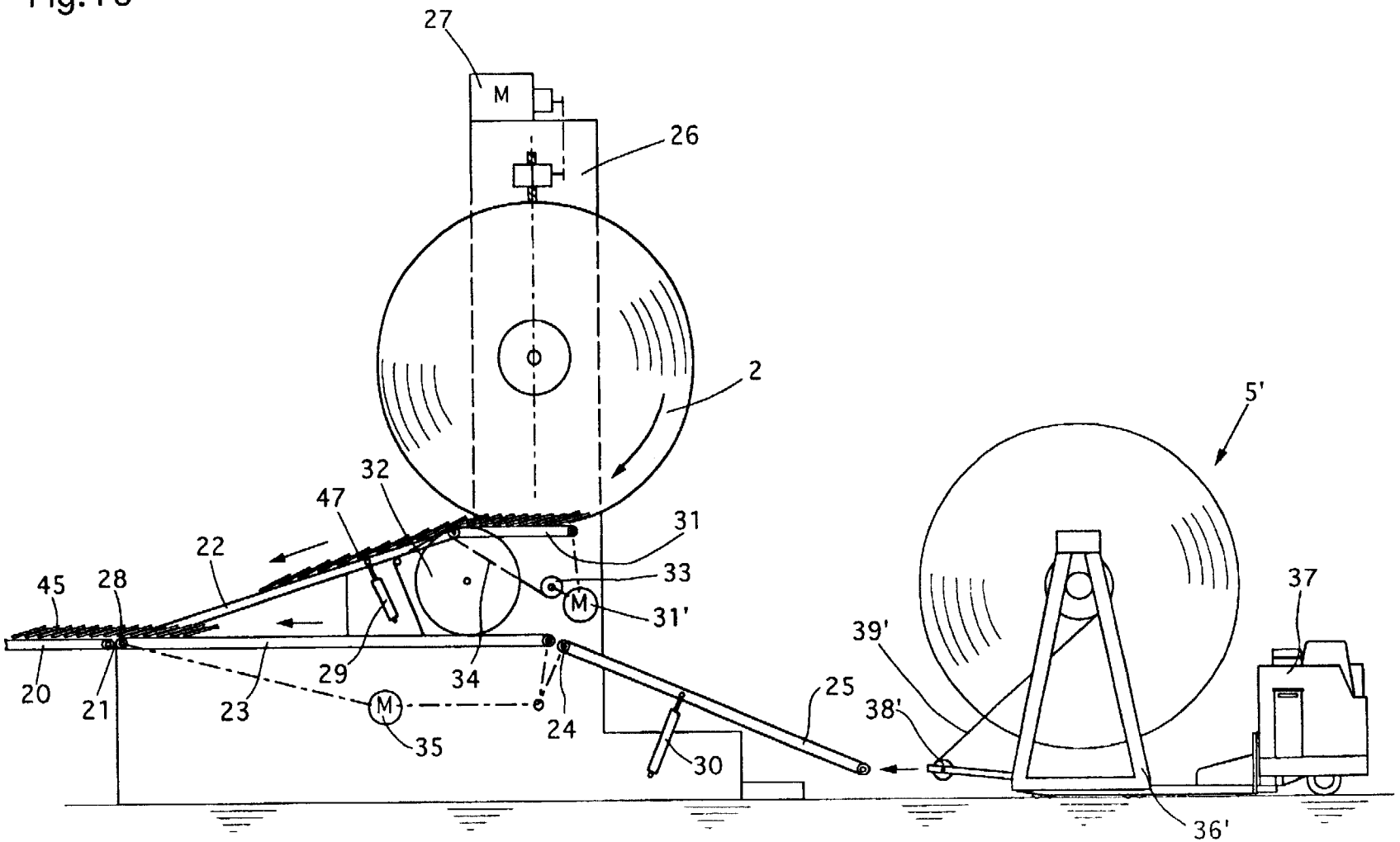
FIG. 10 shows an apparatus for carrying out the unwinding process according to a preferred embodiment of the invention, in a second process stage.

FIG. 10 shows the unwinding operation of FIG. 9 at a stage in which the winding arrangement 5 is completely empty.

The apparatus is operated in such a manner that all the printed products have passed, from the first main roll 4, on the intermediate roll 2 at the correct time, so that the direction of rotation of the intermediate roll 2 can be reversed at the correct time in order to ensure that the imbricated stream running away from the overall apparatus is not interrupted when the second main roll 10 is fully unwound and the further imbricated stream from the intermediate roll 2 is made available. This can be achieved, as earlier described, by winding up the products on the intermediate roll faster from the first main roll 4 than the products are unwound from the second main roll 10.

As soon as the products unwound from the first main roll 4 are fully wound up on the intermediate roll 2, the lifting-piston arrangement 29 is actuated such that the arrangement illustrated in FIG. 10 is established, in which arrangement an imbricated stream can pass from the conveying device 31 to the first branch 22.

At the time, before the end of the imbricated stream 45 originating from the second main roll 10 passes the switch 21, the direction of rotation of the intermediate roll 2 and of the conveying device 31 is reversed, as illustrated in FIG. 10. The result is that the printed products wound up on the intermediate roll 2 are unwound therefrom and are transported, through the conveying device 31 and the first branch 22, to the removal means 20.

In this arrangement, said imbricated stream 47 originating from the intermediate roll 2 is oriented in the same way as the imbricated stream 45 originating from the second main roll 10. That is, the leading edge is formed by the folded edge of the printed products in each case, said leading edge coming to rest beneath the preceding printed product in each case.

The timing of the above-described operations is, in this arrangement, controlled such that the beginning of the imbricated stream 47 joins the end of the imbricated stream 45 without interruption, with the result that, through the removal device 20, a continuous imbricated stream is available.

As the imbricated stream 47 is unwound from the intermediate roll 2, the winding arrangement 5 has no function to fulfil, and can be exchanged, during this period of time, for a new, fully wound winding arrangement 5', 36', 38', 39'. As soon as the intermediate roll 2 is then fully unwound, the process step illustrated in FIG. 9 can begin. Accordingly, two imbricated streams are unwound from the winding arrangement 5', of which one imbricated stream passes, through the removal means 20, directly to further processing and the other imbricated stream passes to the intermediate roller 2. In this arrangement, the timing is controlled such that the beginning of the imbricated stream originating from the second main roll of the winding arrangement 5' joins, without interruption, the end of the imbricated stream 47 unwound from the intermediate roll 2.

The apparatus represented in FIGS. 6 to 10 is preferably designed such that the intermediate roll 2 can optionally be assigned to the first main roll or to the second main roll of the winding arrangement 5. An assignment of this type can be achieved, for example, by moving the intermediate roll with respect to the stationary main rolls or by moving the main rolls with respect to the stationary intermediate roll.

By virtue of such a modified assignment of intermediate roll and main rolls, then, for example in the case of an unwinding process carried out corresponding to FIGS. 9 and 10, unwinding according to FIG. 2 can also be achieved. As a result of this modification, there is ultimately made available an imbricated stream in which the leading edge is formed by the open edge of the printed products, the open edge resting beneath the preceding printed product.

Figure 11:
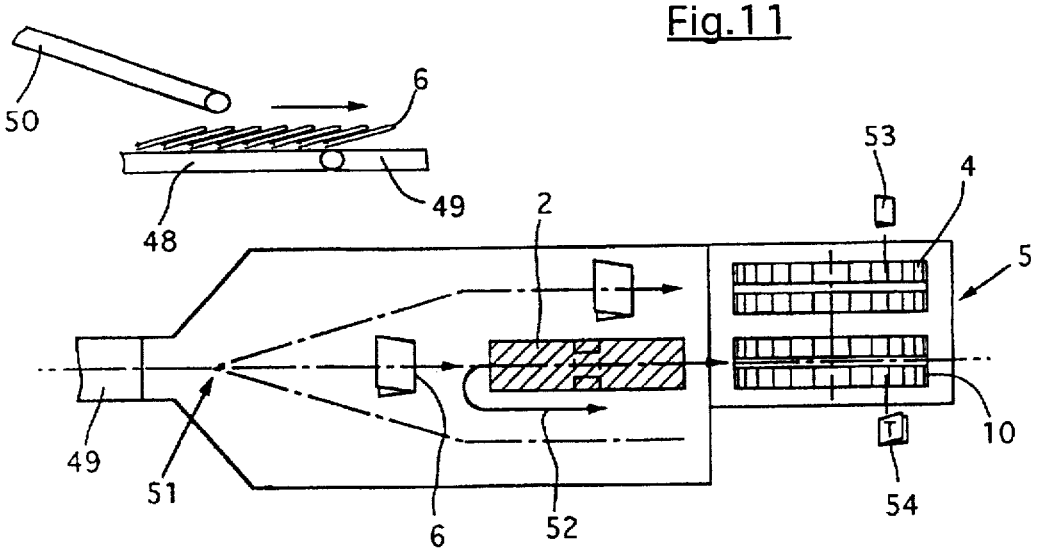
FIG. 11 shows a schematic representation of the possible product stream in the event of products being wound up according to the invention by a preferred apparatus, in accordance with a first mode of operation.

FIG. 11 shows, schematically, the interaction of winding arrangement 5 and intermediate roll 2 when printed products are wound up on the winding arrangement 5. The detail represented in the top sketch of FIG. 11 shows an imbricated stream which is fed to the overall apparatus through conveying means 48, 49 and is oriented such that the leading edge is formed by the folded edge 6 of the printed products, the folded edge 6 coming to rest on the preceding printed product.

The imbricated stream oriented in this manner passes, through the conveying device 49, to a switch 51 which is initially set such that the imbricated stream is wound up on the intermediate roll 2. As soon as the intermediate roll 2 is fully wound, its direction of rotation is reversed and the switch 51 is set such that the imbricated stream passes to the left of the intermediate roll 2, from the conveying means 49 to the first main roll 4 of the winding arrangement 5. The printed products then unwind simultaneously from the intermediate roll 2 are turned, as represented by the arrow 52 and fed to the second main roller 10 of the winding arrangement 5.

Imbricated streams having different orientation are thus wound up simultaneously on the two main rolls 4, 10. This different orientation is illustrated by the individual printed products 53, 54 shown schematically in FIG. 11.

In the case of the printed products 53 wound up on the first main roll 4, the leading edge is formed by the folded edge, said folded edge facing the winding core of the main roll 4. In the case of the printed products 54 wound up on the second main roll 10, the leading edge is formed by the open edge, the open edge facing the winding core of the second main roll 10. A winding formation according to FIG. 1 is thus obtained.

Figure 12:
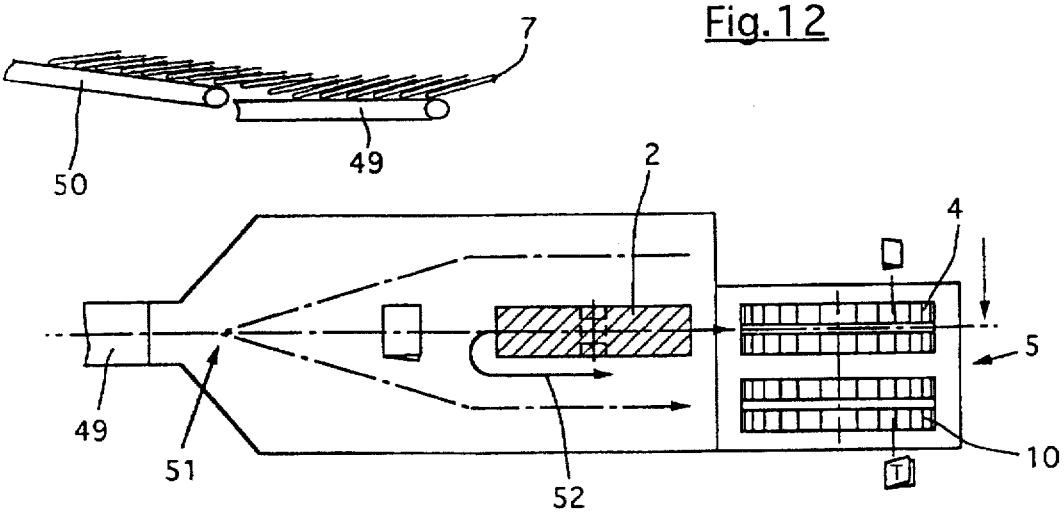
FIG. 12 shows a schematic representation of the possible product stream in the event of products being wound up according to the invention by preferred apparatus, in accordance with a second mode of operation.

FIG. 12 shows the apparatus according to FIG. 11, the winding arrangement, here, being displaced with respect to the intermediate roll 2 in such a manner that the intermediate roll 2 is assigned to the first main roll 4 and the printed products pass directly from the conveying means 49 to the winding arrangement 5 pass, through the correspondingly changed-over switch 51, to the right of the intermediate roll 2, to the second main roll 10 of the winding arrangement 5.

In this case, the imbricated stream passing through the conveying device 50, 49 to the switch 51 is oriented such that the leading edge is formed by the open edge 7 in each case, said open edge 7 coming to rest on the respectively preceding printed product.

With this orientation, the imbricated stream is fed directly to the second main roll 10, the open edges of the printed products facing the winding core of the second main roll 10.

The first main roll 4 is wound, through the intermediate roll 2 which has been previously wound, at the same time as the main roll 10 is being wound. As a result of the fed printed products being wound up previously on the intermediate roll 2 and of the subsequent unwinding, involving a reversing operation as represented by arrow 52, of the printed products from the intermediate roll 2, the printed products are fed to the first main roll 4 with an orientation in which the leading edge is formed by the folded edge of the printed products, the folded edge resting on the respectively preceding printed product. The folded edge of the printed products wound up on the first main roll 4 is thus facing the winding core of said main roll.

The process illustrated in FIG. 12 thus results in the winding of a winding arrangement 5 with the same orientation as in the case of a process according to FIG. 11. The imbricated stream, however, fed through the conveying device 49, in FIGS. 11 and 12 is oriented differently in each case. This identical formation on the winding arrangement 5 is achieved by the simple displacement of the winding arrangement 5 with respect to the intermediate roll 2 and by the changeover of the switch 51.

Figure 13:
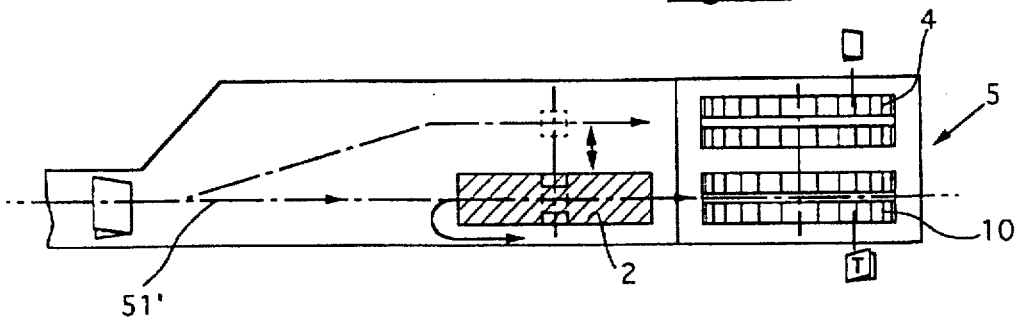
FIG. 13 shows a schematic representation of the possible product stream in the event of products being wound up according to the invention a further preferred apparatus.

FIG. 13 illustrates that the mode of operation described in relation to FIGS. 11 and 12 can also be achieved with the winding arrangement 5 designed to be stationary and the intermediate roll 2 designed to be movable, corresponding to the double arrow shown in FIG. 13. By displacing the intermediate roll 2, it can be assigned either to the first main roll 4 or to the second main roll 10.

An advantage of the embodiment illustrated in FIG. 13 is that the switch 51' can be configured as a double switch, rather than a triple switch, since only the two branches leading to the respective main rolls 4, 10 are charged with an imbricated stream. In the embodiment according to FIGS. 11 and 12, a triple switch 51 is necessary since either the centrally arranged intermediate roll 2 is loaded or the imbricated stream can be guided past the intermediate roll 2 to the right or left.

An embodiment according to FIG. 14 permits operation corresponding to the processes described with reference to FIGS. 11 and 12. The position of the first and second main rolls 4, 10 depicted in solid lines corresponds to the position according to FIG. 12. The position of the first and second main rolls 4, 10 depicted in broken lines corresponds to the position shown in FIG. 11.

The difference from the process according to FIGS. 11 and 12 consists in the fact that, according to FIG. 14, rather than using a triple switch, three double switches 55, 56, 57 are used. As a result of this embodiment which includes switch arrangement 55, 56, 57, the apparatus represented in FIG. 14 can be fed by two different feeding lines 58, 59.

The feeding line 58 can, through the switch 57, be connected either directly to the main roll 4 or to the intermediate roll 2. The feeding line 59 can, through the switch 55, be connected either directly to the second main roll 10 or to the intermediate roll 2. The intermediate roll 2 is assigned either to the first or to the second main roll as a result of the displacement of the main rolls 4, 10.

The same result can thus be achieved with an arrangement according to FIG. 14 as with an arrangement according to FIGS. 11 and 12. This is achieved as a result of the arrangement according to FIG. 14, including two feeding lines 58, 59 arranged one beside the other.

FIG. 15 illustrates an apparatus corresponding to FIGS. 11 to 14, in which two full rolls 60, 61, are provided in the region where the intermediate roll 2 was located. The two full rolls 60, 61 can be unwound one after the other to thus make available a continuous imbricated stream of printed products through the removal device 62. This modified mode of operation of the apparatus makes it possible to process printed products, which are not wound up on a double roll, carried by a first and a second main roll.

FIG. 16 shows an apparatus, in which rolls 63 wound with printed products can be inserted at either of two different positions, at which they are assigned either to the first main roll 4 or to the second main roll 10. From these positions, the printed products, in conjunction with a reversing operation, can be wound on the two main rolls 4, 10. As a result, the printed products will be oriented in the same direction on the two main rolls 4, 10.

By virtue of this re-winding of printed products from one or more single rolls 63, installed one after the other in the apparatus, on a double roll 4, 10, a continuous imbricated stream can be produced when the printed products are subsequently unwound from the double rolls 4, 10. Such a result is not possible when unwinding printed products from a single roll 63. Since the printed products according to FIG. 16 are oriented in the same direction on the main rolls 4, 10, the printed products can be guided away from the main rolls 4, 10 directly and without the interposition of an intermediate roll.

When the printed products are unwound from the main rolls 4, 10, preferably only that main roll from which the printed products are being unwound is driven.

The foregoing description of the preferred embodiments of the present invention has been presented for purposes of illustration and description. The described embodiments are not intended to be exhaustive or to limit the invention to the precise forms disclosed. Obviously many modifications and variations are possible in light of the above teachings. The embodiments which were described were chosen in order to best explain the principles of the invention and its practical applications. It is intended that the scope of the invention be defined by the following claims, including all equivalents.

I claim:

1. A process for storing a continuous stream of sheet-like products comprising the steps of winding up a first number of the products belonging to a first part of the continuous stream on a first main roll and simultaneously winding up a second number of the products belonging to a second part of the continuous stream on a second main roll, the first main roll and the second main roll being arranged side-by-side.

2. The process according to claim 1, further comprising the steps of activating the first and second main rolls by separate drives and periodically driving the first and second main rolls at different speeds.

3. The process according to claim 1, further comprising the steps of performing the winding-up operation at a first station and performing an unwinding operation at a second station.

4. The process according to claim 1, further comprising the step of winding at least one of the first and the second number of the products on an intermediate roll, before being wound up on the first main roll and the second main roll, respectively.

5. The process according to claim 4, further comprising the step of arranging the continuous stream of products such that, during winding up, a leading edge of the products comes to rest against one of the first and second main rolls and [the core of]the intermediate roll.

6. The process according to claim 4, further comprising the step of reversing the direction of flow of the products before winding at least one of the first and second number of the products on the intermediate roll or after unwinding the products from the intermediate roll.

7. The process according to claim 4, wherein the steps of winding up the first and second main rolls and the intermediate roll further comprise the step of feeding the products essentially horizontally from a side of the intermediate roll that is remote from the first and second main rolls.

8. The process according to claim 4, further comprising the step of assigning the intermediate roll to one of the first main roll and the second main roll during winding up.

9. The process according to claim 8, wherein the step of assigning the intermediate roll is achieved by the step of moving the intermediate roll with respect to the first and second main rolls.

10. The process according to claim 8, wherein the step of assigning the intermediate roll is achieved by the step of maintaining the intermediate roll stationary and by the step of moving the first and second main rolls with respect to the stationary intermediate roll.

11. The process according to claim 4, further comprising the steps of feeding the products to one of the first and second main rolls directly, and feeding the products to the other of the first and second main rolls indirectly through the intermediate roll that was previously wound.

12. The process according to claim 11, further comprising the step of driving the main roll that is fed with products indirectly through the intermediate roll at a faster rate than the other main roll, in order to permit continuous feeding of the products.

13. The process according to claim 11, further comprising the step of winding up fewer products on the main roll that is fed with products indirectly through the intermediate roll than are wound up on the main roll that is fed with products directly to permit continuous removal of the products.

14. The process according to claim 11, further comprising the step of initiating the feed of the products to the main roll that is fed with products indirectly through the intermediate roll later than the feed to the main roll that is fed with products directly, in order to permit continuous removal of the products.

15. An apparatus for storing a continuous stream of sheet-like products comprising:

a winding arrangement including a first main roll and a second main roll, the first main roll and the second main roll being arranged side-by-side;

a driver for simultaneously driving the first and second main rolls in a winding direction to simultaneously wind up a first number of products belonging to a first part of the continuous stream on the first main roll and a second number of products belonging to a second part of the continuous stream on the second main roll; and a conveyor for feeding the products of the continuous stream to the winding arrangement.

16. The apparatus according to claim 15, wherein the first and second main rolls are mechanically coupled.

17. The apparatus according to claim 15, wherein an axis of rotation of the first main roll coincides with an axis of rotation of the second main roll.

18. The apparatus according to claim 15, wherein the first and second main rolls can be removed from the winding arrangement.

19. The apparatus according to claim 15, wherein the conveyor moves the products essentially horizontally and is located upstream of the winding arrangement.

20. The apparatus according to claim 15, wherein each of the first and second main rolls is coupled to a separate drive.

21. The apparatus according to claim 15, wherein an intermediate roll that can be driven in the opposite direction of the first and second main rolls is assigned to the first and second main rolls.

22. The apparatus according to claim 21, wherein the intermediate roll can be removed from the apparatus.

23. The apparatus according to claim 21, wherein the intermediate roll is coupled to a reversing station.

24. The apparatus according to claim 21, wherein a supply roller is assigned to each of the first and second main rolls and to the intermediate roll for supplying a separating band that is connected, at one end to a winding core of one of the first and second main rolls and the intermediate roll, the band being wound between wound layers of the products under tensile stress.

25. The apparatus according to claim 21, wherein the intermediate roll is a constituent part of a branch of a feeder.

26. The apparatus according to claim 25, wherein the feeder has a first branch, a second branch, and a third branch, each branch arranged essentially one beside the other, the intermediate roll being a stationary constituent part of the first branch, and the first and second main rolls can alternatively be coupled to the first branch and either one of the second and third branches.

27. The apparatus according to claim 25, wherein the feeder has a first branch and a second branch arranged essentially one beside the other, the first and second main rolls are coupled to the first and second branches, and the intermediate roll can alternatively be switched into one of the first and second branches.

28. A process for processing a continuous stream of sheet-like products comprising the steps of unwinding a first number of the products forming a first part from a first main roll and simultaneously unwinding a second number of the products forming a second part from a second main roll, the first main roll and the second main roll being arranged side-by-side.

29. The process according to claim 28, further comprising the steps of activating the first and second main rolls by separate drives and periodically driving the first and second main rolls at different speeds.

30. The process according to claim 28, further comprising the steps of performing a winding-up operation at one station and performing the unwinding operation at a second station.

31. The process according to claim 28, wherein at least one of the first and the second number of the products, after being unwound from the first main roll and the second main roll, respectively, and before being guided away, is first wound up to form an intermediate roll and is subsequently unwound from the intermediate roll.

32. The process according to claim 31, further comprising the step of reversing the direction of flow of the products before winding at least one of the first and second number of the products on the intermediate roll or after unwinding the products from the intermediate roll.

33. The process according to claim 31, further comprising the step of guiding the products away along an essentially horizontal path from a side of the intermediate roll that is remote from the first and second main rolls.

34. The process according to claim 31, further comprising the steps of guiding products away from one of the first and second main rolls directly and guiding products away from the other of the first and second main rolls indirectly through the intermediate roll, during unwinding from the first and second main rolls.

35. The process according to claim 34, further comprising the step of unwinding the products to be guided away through the intermediate roll at a faster rate from the respective main roll than the products to be guided away directly to permit continuous removal of the products during unwinding.

36. The process according to claim 31, further comprising the step of assigning the intermediate roll to one of the first and the second main rolls during unwinding.

37. The process according to claim 36, wherein the step of assigning the intermediate roll is achieved by the step of moving the intermediate roll with respect to the first and second main rolls.

38. The process according to claim 37, wherein the step of assigning the intermediate roll is achieved by the step of maintaining the intermediate roll stationary and by the step of moving the first and second main rolls with respect to the stationary intermediate roll.

39. An apparatus for processing a continuous stream of sheet-like products comprising:

an unwinding arrangement including a first main roll having a first number of wound-up products, and a second main roll having a second number of wound-up products, the first main roll and the second main roll being arranged side-by-side;

a driver for simultaneously driving the first and second main rolls in an unwinding direction to simultaneously unwind the first number of products from the first main roll and the second number of products from the second main roll; and a conveyor for carrying away the unwound products from the unwinding arrangement.

40. The apparatus according to claim 39, wherein the first and second main rolls are mechanically coupled.

41. The apparatus according to claim 39, wherein an axis of rotation of the first main roll coincides with an axis of rotation of the second main roll.

42. The apparatus according to claim 39, wherein the first and second main rolls can be removed from the unwinding arrangement.

43. The apparatus according to claim 39, wherein the conveyor moves the products essentially horizontally and is located downstream of the unwinding arrangement.

44. The apparatus according to claim 39, wherein each of the first and second main roll is coupled to a separate drive.

45. The apparatus according to claim 39, wherein an intermediate roll which can be driven in the opposite direction of the first and second main rolls is assigned to the first and second main rolls.

46. The apparatus according to claim 45, wherein the intermediate roll can be removed from the apparatus.

47. The apparatus according to claim 45, wherein the intermediate roll is coupled to a reversing station.

48. The apparatus according to claim 45, wherein a supply roller is assigned to each of the first and second main rolls and to the intermediate roll for supplying a separating band that is connected, at one end, to a winding core of one of the first and second main rolls and the intermediate roll, the band being wound between wound layers of the products under tensile stress.

49. The apparatus according to claim 45, wherein the intermediate roll is a constituent part of a remover having at least two branches and a changeover device through which the branches can alternatively be charged with products, with the result that the first and second main rolls can alternatively be coupled to the product stream directly or indirectly through the respective branch.

50. The apparatus according to claim 49, wherein the remover has a first branch, a second branch, and a third branch, each branch arranged essentially one beside the other, the intermediate roll being a stationary constituent part of the first branch, and the first and second main rolls can alternatively be coupled to the first branch and either one of the second and third branches.

51. The apparatus according to claim 49, wherein the remover has a first branch and a second branch arranged essentially one beside the other, the first and second main rolls are coupled to the first and second branches, and the intermediate roll can alternatively be switched into one of the first and second branches.

* * * * *